US010948181B2

(12) United States Patent
Knight et al.

(10) Patent No.: US 10,948,181 B2
(45) Date of Patent: Mar. 16, 2021

(54) MULTI-LEVEL GAS BURNER HAVING ULTRA LOW SIMMER

(71) Applicants: BSH Home Appliances Corporation, Irvine, CA (US); BSH Hausgeräte GmbH, Munich (DE)

(72) Inventors: Benjamin Knight, New Bern, NC (US); Brian Silva, Knoxville, TN (US); Tyson White, Anderson, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 134 days.

(21) Appl. No.: 16/419,033

(22) Filed: May 22, 2019

(65) Prior Publication Data

US 2020/0370747 A1 Nov. 26, 2020

(51) Int. Cl.

| | |
|---|---|
| ***F23D 14/04*** | (2006.01) |
| ***F24C 3/08*** | (2006.01) |
| ***F23N 1/02*** | (2006.01) |

(52) U.S. Cl.

CPC ..... *F23D 14/04* (2013.01); *F23N 1/027* (2013.01); *F24C 3/085* (2013.01); *F23D 2900/14062* (2013.01); *F23N 2237/02* (2020.01); *F23N 2241/08* (2020.01)

(58) Field of Classification Search

CPC ..... F23D 2900/14062; F23D 14/04; F24C 3/085; F23N 2241/08

See application file for complete search history.

(56) References Cited

U.S. PATENT DOCUMENTS

| | | | | |
|---|---|---|---|---|
| 5,649,822 | A * | 7/1997 | Gertler | F23D 14/06 126/39 E |
| 6,263,868 | B1 | 7/2001 | Koch et al. | |
| 6,322,354 | B1 | 11/2001 | Carbone et al. | |
| 7,291,009 | B2 | 11/2007 | Kamal et al. | |
| 7,661,954 | B2 | 2/2010 | Harneit | |
| 8,747,108 | B2 * | 6/2014 | Lona Santoyo | F23D 14/06 431/284 |
| 8,845,326 | B2 | 9/2014 | Shaffer et al. | |
| 8,932,049 | B2 | 1/2015 | Ryu et al. | |
| 10,274,202 | B2 * | 4/2019 | Cadima | F24C 15/04 |
| 10,393,371 | B2 * | 8/2019 | Manrique | F23D 14/06 |
| 10,551,056 | B2 * | 2/2020 | Caloca | F23D 14/06 |
| 10,677,469 | B2 * | 6/2020 | Paller | F24C 3/122 |
| 10,690,351 | B2 * | 6/2020 | Adams | F23D 14/06 |

(Continued)

*Primary Examiner* — David J Laux
*Assistant Examiner* — Nikhil P Mashruwala
(74) *Attorney, Agent, or Firm* — Michael E. Tschupp; Andre Pallapies; Brandon G. Braun

(57) ABSTRACT

A cooking appliance is provided, including a multi-level gas burner with a body having a lower burner section on a lower side and an upper burner section on an upper side. The lower burner section is separated from the upper burner section. The lower side of the body has a first injection point for receiving a first air-gas mixture for the lower burner section and a second injection point for receiving a second air-gas mixture for the upper burner section. The first injection point is partitioned from the second injection point thereby separating the first air-gas mixture from the second air-gas mixture. The body includes a passageway fluidly connecting the second injection point on the lower side of the body to the upper burner section on the upper side of the body.

24 Claims, 13 Drawing Sheets

(56) References Cited

U.S. PATENT DOCUMENTS

| | | | | |
|---|---|---|---|---|
| 10,753,617 | B2 * | 8/2020 | Cadima | F23N 1/007 |
| 10,823,402 | B2 * | 11/2020 | Cadima | F23D 14/24 |
| 2017/0227231 | A1 * | 8/2017 | Pionek | F24C 3/124 |
| 2019/0017709 | A1 * | 1/2019 | Cadima | F24C 3/08 |
| 2020/0191387 | A1 * | 6/2020 | Noeth | F23D 14/06 |

* cited by examiner

MULTI-LEVEL GAS BURNER HAVING ULTRA LOW SIMMER

FIELD OF THE INVENTION

The present invention is directed to a multi-level gas burner, and a cooking appliance having a multi-level gas burner, and more particularly, a multi-level gas burner having an ultra-low simmer.

BACKGROUND OF THE INVENTION

Conventional gas surface cooking units, such as a gas range, stove, or cooktop, may include one or more gas burners for heating foodstuff in a cooking vessel, such as a pot, pan, kettle, etc. To provide more cooking options, some conventional cooking units include a separate simmer or warming burner with a lower BTU, or a gas burner with a simmer function that can operate at low BTUs. To provide a simmer functionality, some conventional cooking units cycle a burner on/off in order to reduce a heat output of the burner, while others generally stack two burner assemblies on top of each other to provide two flame rings capable of providing different BTUs.

SUMMARY OF THE INVENTION

The present invention recognizes that, while some conventional appliances have a gas burner with simmer functionality, conventional burners typically are not capable of providing both high heat output and ultra-low simmer capabilities (e.g., 500 BTU), while at the same time providing greater range or control of the heat output or distribution of the heat output.

To solve these and other problems, the present invention provides a multi-level gas burner for a cooktop, and particularly a dual flame ring, multi-level gas burner having separate, individually controllable gas supplies for each level, using for example a multi-valve system. An upper level burner section can be utilized for high power cooking (e.g., 22,000 BTU or greater) and a lower level burner section can be utilized for ultra-low simmer (e.g., approximately 500 BTU). By having two levels of burners, the amount of heat that is distributed to a cooking vessel can be adjusted by changing which level of the burner (e.g., which height) is supplied with an air-gas mixture for the cooking application. The ultra-low simmer on the lower level can enable heat distribution to be controlled to the cooking vessel to provide optimal ultra-low simmer temperatures to minimize a chance of scorching.

An exemplary embodiment of the invention is directed to a gas burner for a cooktop floor of a cooking appliance, the gas burner including a body having a lower burner section on a lower side and an upper burner section on an upper side, the lower burner section being separated from the upper burner section, the lower side of the body having a first injection point for receiving a first air-gas mixture for the lower burner section and a second injection point for receiving a second air-gas mixture for the upper burner section, the first injection point being partitioned from the second injection point thereby separating the first air-gas mixture from the second air-gas mixture, wherein the body includes a passageway fluidly connecting the second injection point on the lower side of the body to the upper burner section on the upper side of the body. In this way, the lower and upper burner sections can be separately supplied with air-gas mixtures such that the lower and upper burner sections provide lower and upper flame rings that can be operated independently or at the same time, thereby providing a greater level of control of the heat output of the burner, as well as control of a distribution of the heat output, such as a distance/proximity (e.g., vertical distance) of the flame rings with respect to a cooking vessel on the cooking support surface.

The gas burner can include a central opening such that the lower and upper burner sections can provide lower and upper dual flame rings, with one flame ring around an outer perimeter of the burner and another flame ring around a perimeter of the central opening of each of the burner sections. Such dual ring lower and upper burner sections can provide greater control of the distribution of the heat output, such as a location (e.g., laterally or radially from a center of the burner) of each of the dual flame rings at each level and/or a distance/proximity (e.g., vertical distance) of each of the dual flame rings with respect to a cooking vessel on a cooking support surface.

In other examples, the gas burner can include a plurality of injection points in the lower burner section for separately supplying air-gas mixtures to both the lower and upper burner sections. The lower and/or upper burner sections can include one or more partition walls dividing the respective burner sections into a plurality of separate chambers, with each of the separate chambers having a separate injection point for separately supplying air-gas mixtures to the separate chambers and providing partial flame rings (e.g., a half, third, quarter flame ring, etc.). The air-gas mixtures injected at the injection points can be separately controllable (e.g., by one or more individual control valves, a dual control valve, a valve assembly, etc.) such that one or more portions of the dual flame rings for the lower and upper burner sections respectively, can be configured to be separately and independently controllable from one or more of the other flame ring portions. In this way, not only can the lower burner section be independently operable and controllable from the upper burner section, but one or more chambers within the lower and/or upper burner sections and the corresponding partial flame rings can be independently operable and controllable from the others, thereby providing a greater level of control of the heat output of the burner, as well as greater control of the distribution of the heat output, such as a location (e.g., laterally or radially from a center of the burner) of various portions of the flame rings and/or a distance/proximity (e.g., vertical distance) of various portions of the flame rings with respect to a cooking vessel on the cooking support surface.

The example burners can provide a large range of heating options ranging from, for example, 500 BTU to 22,000 BTU or greater. For example, in one instance, all of the chambers in the lower and upper burner sections can be supplied with a maximum flow of an air-gas mixture at one time to provide a maximum BTU output for the burner (e.g., 22,000 BTU or more). In other instances, one or more chambers within the lower burner section and/or the upper burner section can be reduced, or turned off completely, to selectively reduce an amount of heat, alter a distribution of the heat (e.g., a location of the heat laterally or radially, a vertical proximity of the heat, etc.) with respect to the cooking vessel, thereby providing greater control of the amount, intensity, and distribution of the heat for cooking operations. In a further example, a user may turn off a flow of the air-gas mixture to all of the chambers of the upper burner section to reduce a heat output of the burner at the outermost perimeter of the burner and at a location that is vertically closest to the cooking vessel, as well as turn off all but one of the chambers of the lower burner section, thereby leaving only a single chamber of the lower burner section to be supplied with an air-gas mixture such that a partial flame ring (e.g., a half, third, quarter flame ring, etc.) is provided at a lowest vertical location on the burner and a more centrally located position with respect to the burner to provide an ultra-low simmer having a minimum BTU output for the burner (e.g., 500 BTU), which may reduce or minimize chances of scorching. These features also may be beneficial for providing greater control of the amount, intensity, and distribution of the heat for particular cooking operations, such as wok cooking.

The supply of gas to the lower and/or upper burner sections, or chambers of the lower and/or upper burner sections, can be separately provided by individual control valves, a dual control valve, a valve assembly, etc. In some examples, a control unit can be configured to control the control valves to separately and independently control a flow of the air-gas mixtures to the lower and upper burner sections.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

With reference to FIGS. 1-16, exemplary embodiments of a cooking appliance 10 including a gas surface cooking unit 100 having a multi-level gas burner 300, will now be described.

Figure 1:
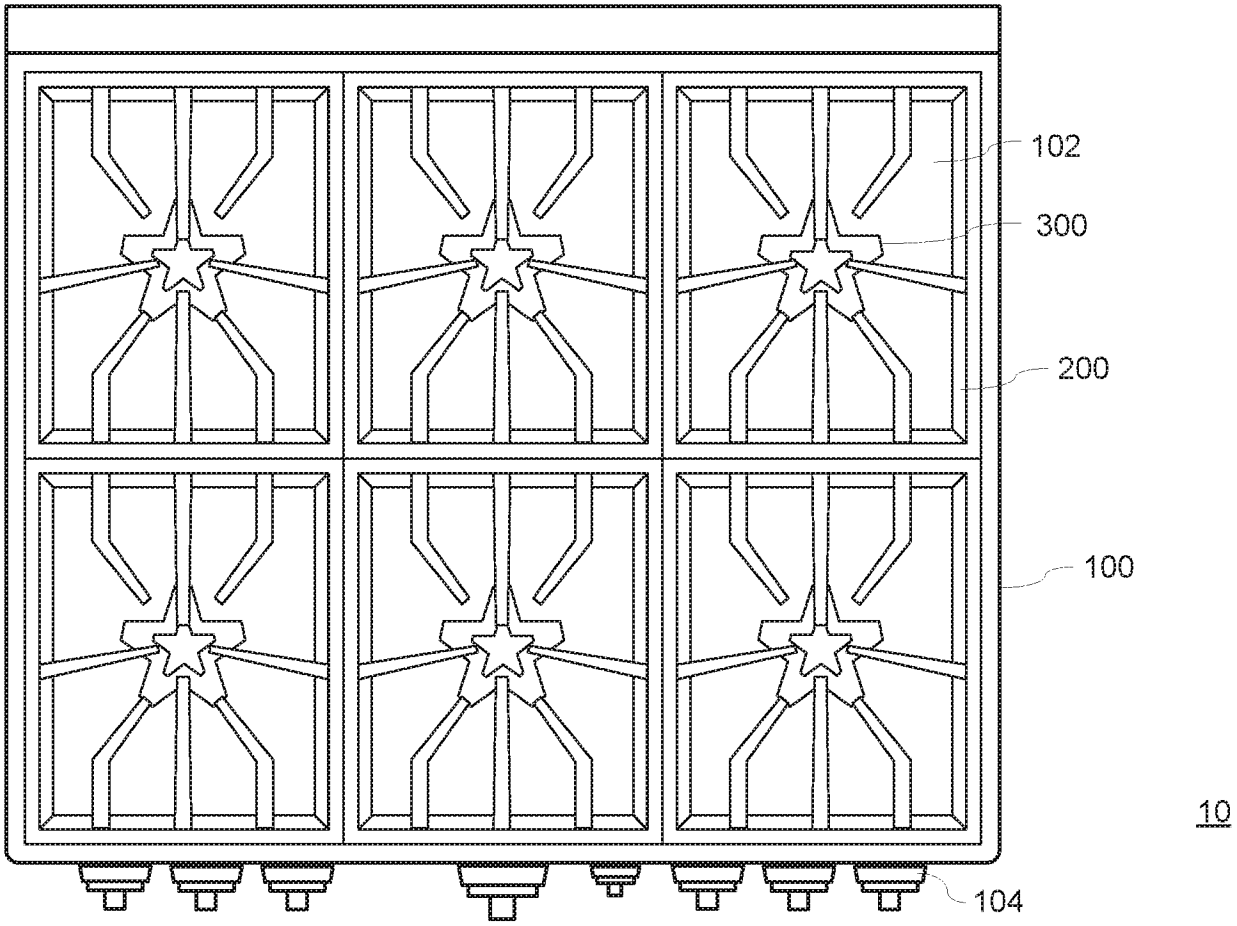
FIG. 1 is a top view of a cooking appliance having a multi-level gas burner according to an exemplary embodiment of the invention.

FIG. 1 illustrates an example of a cooking appliance 10 having a gas surface cooking unit 100 including one or more gas burners 300 for heating foodstuff in a cooking vessel, such as a pot, pan, kettle, etc. The gas surface cooking unit 100 can be, for example, a surface cooking unit of a freestanding or slide-in gas range (e.g., a gas cooktop, gas or electric oven combination, dual-fuel range, etc.), a gas cooktop or rangetop (e.g., counter mounted, island mounted, etc.), a gas hob, a gas stove, a gas grill, a standalone gas burner cooker (e.g., a countertop cooker), etc. The gas surface cooking unit 100 can include a cooktop floor 102 (e.g., a fixed or removable spill tray or top sheet, glass surface, etc.) for catching spills, overflows, etc. from a cooking vessel and/or for concealing other components of the cooking unit, such as gas supply lines, electrical wiring, etc. (not visible in FIG. 1). The gas surface cooking unit 100 includes one or more cooking vessel supports 200, such as a cooking grate, griddle, grill, teppanyaki grill, etc., for supporting one or more cooking vessels above one or more gas burners 300. The cooking vessel supports 200 can be removable from the gas surface cooking unit 100 (e.g., removable from the cooktop floor 102 for cleaning, repairs, maintenance, etc.). In other examples, the cooking vessel supports 200 can be moveable with respect to the gas surface cooking unit 100 (e.g., the cooktop floor 102), such as being hinged with respect to the cooktop floor 102 of the gas surface cooking unit 100, or arranged to be elevated from the cooktop floor 102 of the gas surface cooking unit 100, etc. The gas surface cooking unit 100 can include a control panel, such as one or more control knobs 104, for controlling one or more gas burners 300, or other cooking components (e.g., oven, warming drawer, etc.) of the appliance 10.

Figure 2:
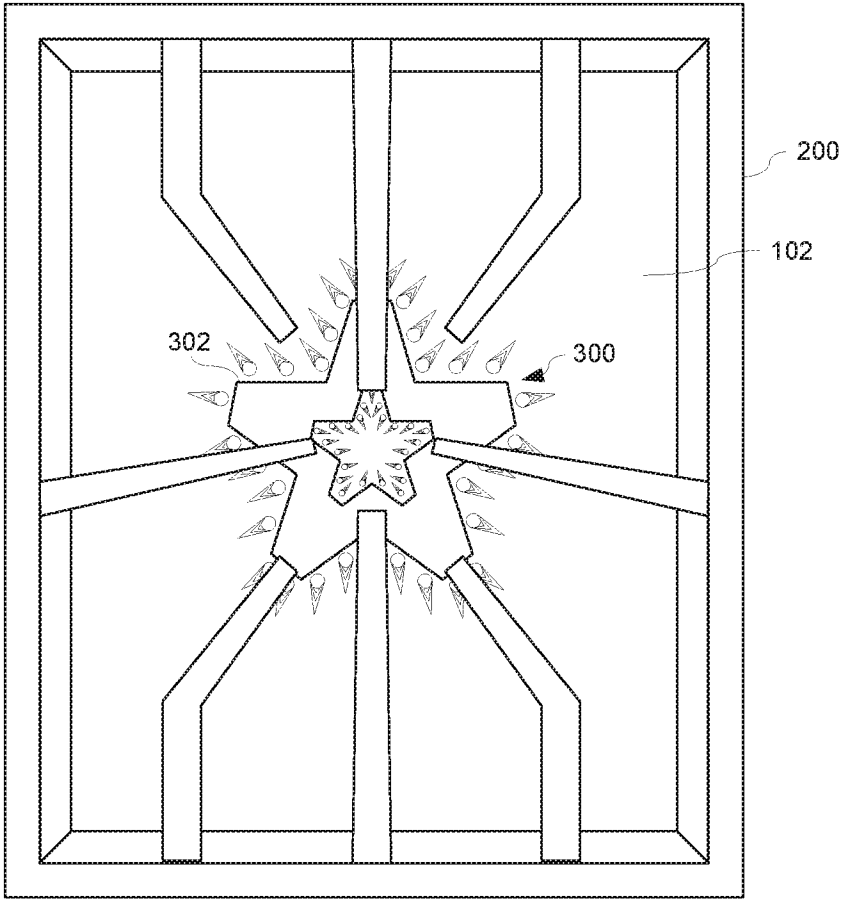
FIG. 2 is a top view of a cooking appliance having a multi-level gas burner according to an exemplary embodiment of the invention.
Figure 3:
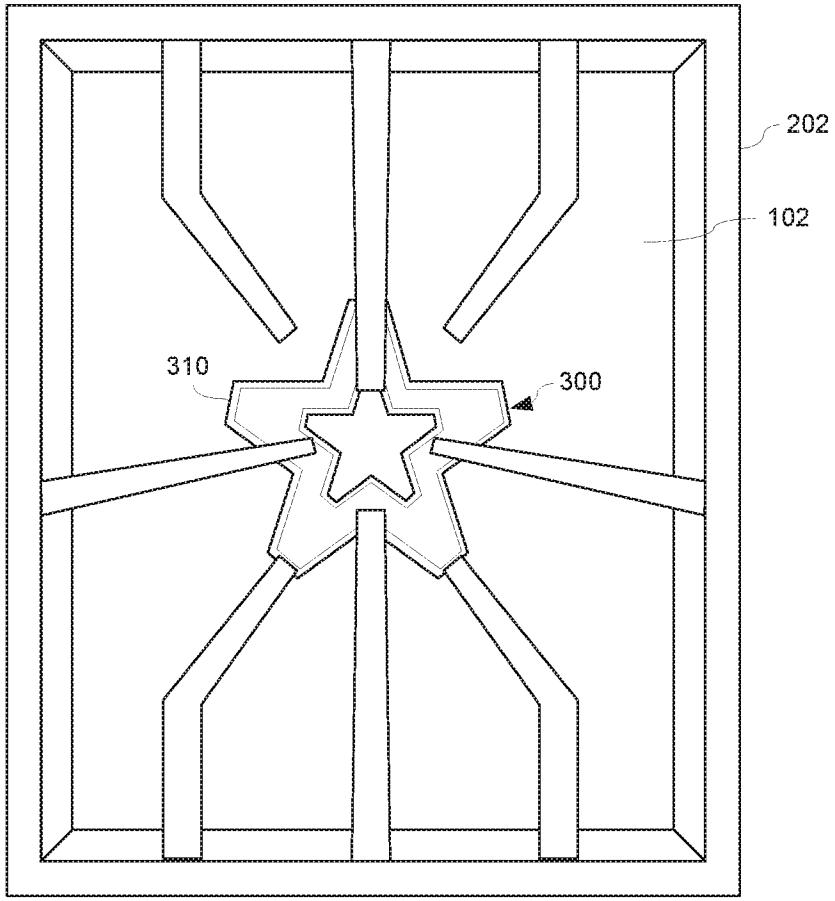
FIG. 3 is another partial top view of the cooking appliance of FIG. 2.

As shown in the example illustrated in FIGS. 2 and 3, the cooking vessel support 200, such as a cooking grate for supporting a cooking vessel, can include a support frame and a plurality of arms for supporting a cooking vessel above a gas burner 300. For example, one or more of the arms can include an upper surface portion that is level with the upper surface portion of one or more other arms to provide a level support surface for supporting a cooking vessel over the gas burner 300. In some examples, the support frame can include one or more upper surface portions around all or a portion of the perimeter of the support frame that are level with the upper surface portions of the arms for providing a level support surface for the cooking vessel. The arms can have various sizes, shapes, or arrangements, such as straight portions, curved portions, angled portions, or combinations thereof, and can extend across all, or a portion, of the width of the support frame. The support frame can be configured to rest directly on an upper surface of the cooktop floor 102 or to be supported above the cooktop floor 102 on another component of the appliance, such as one or more sidewalls adjacent to, and above, the cooktop floor 102. One or more portions of the support frame 202 can be configured to contact (e.g., directly contact) an upper surface of the cooktop floor 102 or another component of the appliance 10. FIG. 2 shows an example of a gas surface cooking unit 100 with a gas burner 300 having a burner cap 302 in place, and FIG. 3 shows a multi-level gas burner 300 with the burner cap 302 removed from the burner body 304 for clarity. As shown in FIG. 2, the gas burner 300 can be configured to provide dual flame rings at each level of the multi-level burner, such as one flame ring around an outer perimeter of the burner body and another flame ring around a perimeter of a central opening of the burner body at each level of the multi-level burner. Such dual ring lower and upper burner sections can provide greater control of the distribution of the heat output, such as a location (e.g., laterally or radially from a center of the burner) of each of the dual flame rings at each level and/or a distance/proximity (e.g., vertical distance) of each of the dual flame rings with respect to a cooking vessel on a cooking support surface.

With reference to FIGS. 4-16, several examples of a multi-level gas burner 300 will now be described. As shown in the examples, a multi-level gas burner 300 can include a burner body 310 (hereinafter body) having a lower burner section 310*a* on a lower (or bottom) side and an upper burner section 310*b* on an upper (or top) side. The lower burner section 310*a* can be separated or partitioned from the upper burner section 310*b* such that each burner section 310*a*, 310*b* is separately controllable and operable independent of the other. As explained in greater detail below, the burner body 310 can include multiple injection points, for example, on the same side of the body 310 (i.e., the lower side of the body) for discretely supplying air-gas mixtures to each of the lower burner section 310*a* and the upper burner section 310*b*. The injection points are separated or partitioned from (i.e., isolated or fluidly disconnected from) each other, thereby separating the first air-gas mixture from the second air-gas mixture. The body 310 includes at least one passageway fluidly connecting an injection point on the lower side of the body 310 to the upper burner section 310*b* on the upper side of the body 310. In this way, the lower and upper burner sections 310*a*, 310*b* can be separately supplied with air-gas mixtures such that the lower and upper burner sections 310*a*, 310*b* can be operated independently or at the same time.

Figure 4:
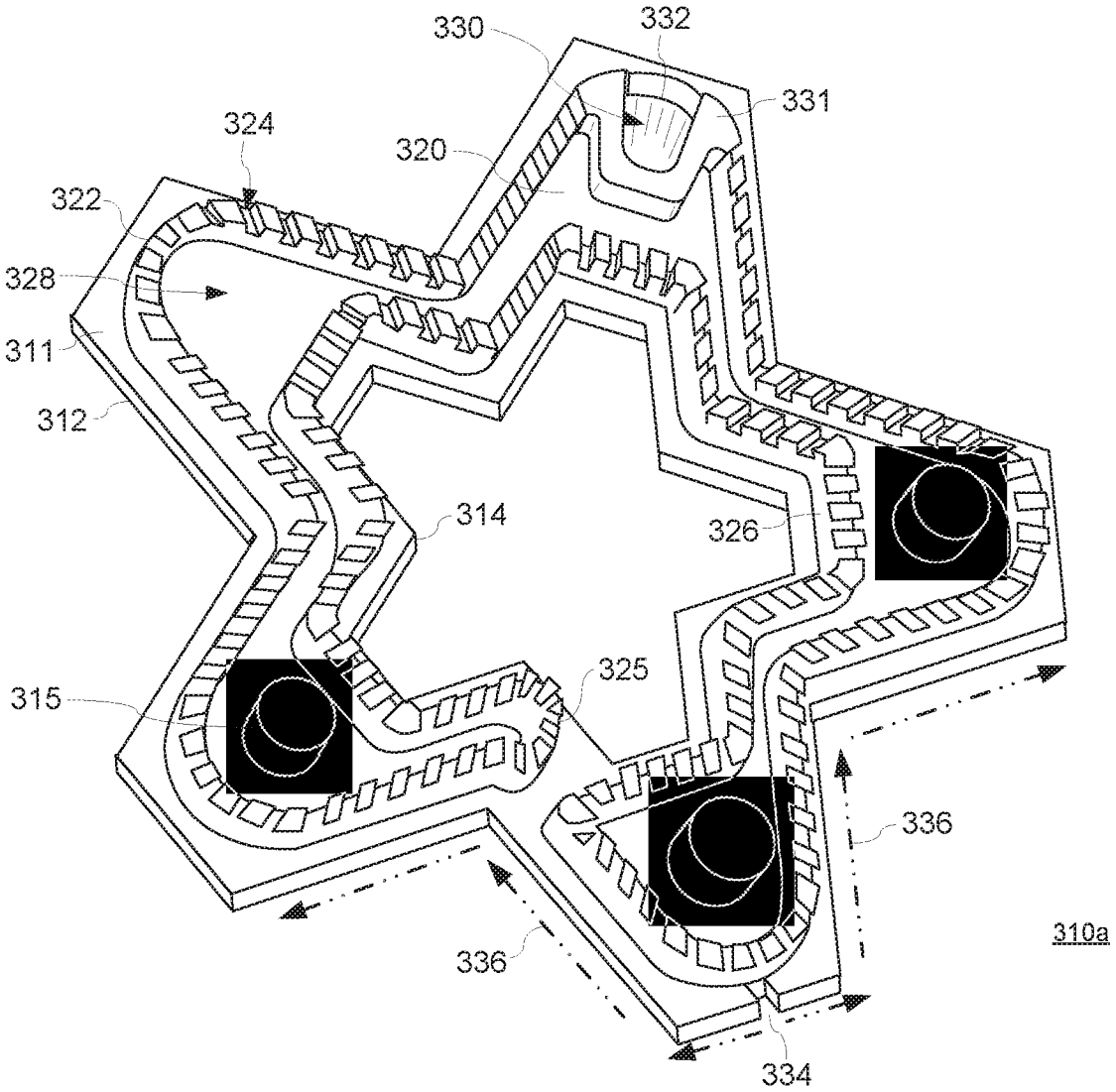
FIG. 4 is a bottom perspective view of a multi-level gas burner body according to an exemplary embodiment of the invention.
Figure 5:
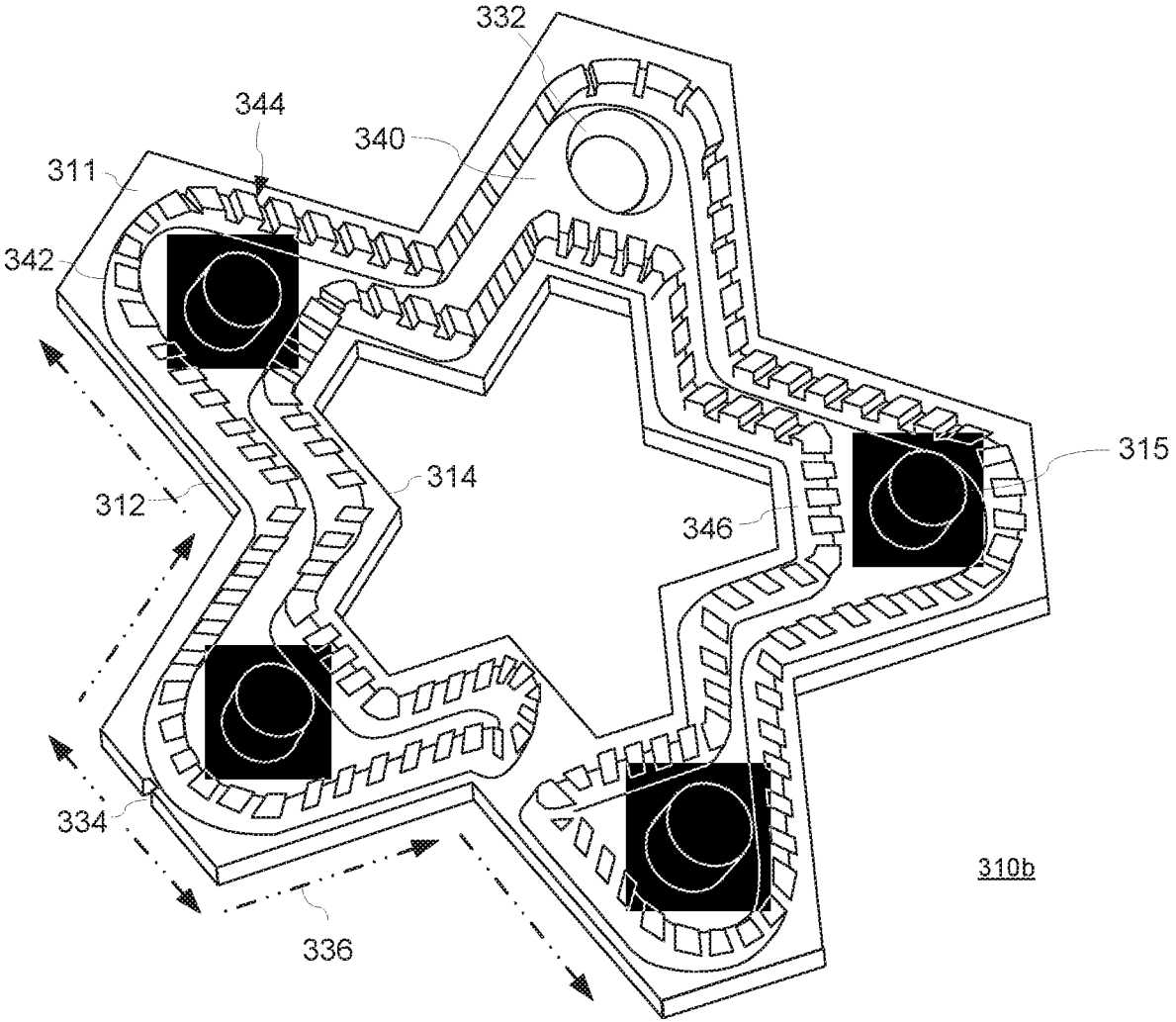
FIG. 5 is a top perspective view of the multi-level gas burner body of FIG. 4.
Figure 9:
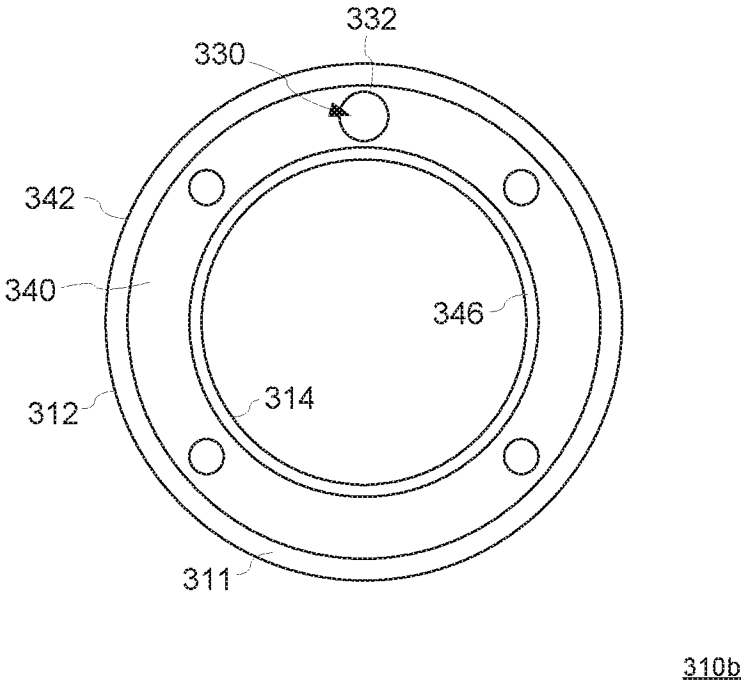
FIG. 9 is a top view of the multi-level gas burner body of FIG. 8.

In the example shown in FIGS. 4 and 5, a multi-level gas burner 300 includes a burner body 310 having a lower burner section 310*a* on a lower (or bottom) side (shown in FIG. 4) and an upper burner section 310*b* on an upper (or top) side (shown in FIG. 5). In this example, the lower burner section is separated or partitioned from the upper burner section by a plate portion 311 of the body 310 (e.g., a common plate portion). In the example of FIGS. 4 and 5, the burner body 310 has a star configuration with a central opening having a corresponding star configuration extending through the lower burner section and the upper burner section. The burner body 310 is not limited to any particular shape or configuration and can have other configurations such as, for example, a circular or oval configuration, a rectangular or square configuration, a triangular configuration, etc. FIGS. 8 and 9 illustrate examples of a burner body 310 having a circular configuration. The burner body 310 can include a central opening, as shown in the examples illustrated in FIGS. 4, 5, and 8-13, or in other examples, the burner body 310 may not have a central opening, as shown in the examples illustrated in FIGS. 6 and 7.

With reference again to the example in FIG. 4, the burner body 310 has an outer perimeter edge 312 defining the outer shape or configuration of the body 310 and an inner perimeter edge 314 defining a shape of the central opening. The lower burner section 310*a*, shown in FIG. 4, can be defined by one or more walls 322, 326 on the lower or bottom side of the common plate 311. The walls 322, 326 extend from and cooperate with a lower (bottom) side, or surface, of the plate 311 to define a first chamber 320 of the lower burner section 310*a* configured to receive a first air-gas mixture. One or more supports 315 can be provided to support the plate 311 on another structure, such as the cooktop floor 102, a volcano-style pedestal, a stand-alone pedestal, or the like, or to support another structure, such as a lower cap, lower plate, or the like for closing the first chamber 320.

The first air-gas mixture can be injected into the first chamber 320 at a first injection point 328 within the first chamber 320 such that the injected air-gas mixture is guided by the walls 322, 326 throughout the first chamber 320. In this example, the lower burner section 310*a* is configured for a single injection point 328. However, in other examples, multiple injection points can be provided, such as an injection point being located in one or more fingers of the star configuration or other locations within the first chamber 320. The walls 322, 326 can include a plurality of ports 324 (i.e., first ports) configured to permit the first air-gas mixture to exit the first chamber 320, where the air-gas mixture can be ignited to form a lower flame ring (as schematically shown for example in FIG. 2). For simplicity, the ports 324 are schematically illustrated in the walls 322, 326. One of ordinary skill will recognize that the ports can have various designs and configurations, such as various shapes, sizes, angles, spacings, etc. and can be formed in all or portions of the walls 322, 326 depending, for example, on the shape/configuration of the perimeter of the burner, desired flame pattern, etc. The plate 311 can include one or more ignition points 334 such that the air-gas mixture exiting one or more of the ports 324 can be ignited at one or more locations, for example, by an igniter (not shown). In this example, the air-gas mixture exiting the ports 324 can be ignited at a single location 334 such that, upon ignition, the flame ring propagates in both directions 336 away from the location 334 around a perimeter of the wall(s) 322, 326 to form the flame ring(s).

The walls 322, 326 can extend, for example, around of a perimeter of the body 310 along an outer edge 312 of the lower or bottom side of the plate 311 and along an inner edge 314 of the central opening. In this example, the walls 322, 326 are formed by a single interconnected, continuous wall extending along both the outer edge 312 and the inner edge 314 to form a single chamber 320. For example, the walls 322, 326 can include one or more portions 325 that interconnect the walls 322, 326 to form a single interconnected, continuous wall. Upon ignition of the air-gas mixture exiting the ports 324, the flame ring can propagate in both directions 336 away from the location 334 around a perimeter of the wall portions 322, 325, 326 to form both the outer and inner flame rings (i.e., dual flame rings, as shown for example in FIG. 2). In other examples, the walls 322, 326 can be separately formed along each edge 312, 314 to form a single chamber 320. The plurality of ports 324 can permit the first air-gas mixture to exit the first chamber 320 along both the outer edge 312 and the inner edge 314, thereby providing both an outer lower flame ring and an inner lower flame ring for the lower burner section 310*a*. The walls 322, 326 are not limited to being formed along the edges 312, 314 and can be configured to have other shapes, sizes, or arrangements, etc. The walls 322, 326 also can be configured to form a plurality of chambers, as will be described with reference to other examples below.

With reference again to the example in FIG. 4, the burner body 310 includes a second injection point 330 for receiving a second air-gas mixture for the upper burner section 310*b* (shown in FIG. 5). The second injection point 330 is separated or partitioned from (i.e., isolated, sealed, or fluidly disconnected from) the first chamber 320 and the first injection point 328 by a partition wall 331, thereby separating the first air-gas mixture from the second air-gas mixture. As shown in FIGS. 4 and 5, a passageway 332 extends through the plate 311 and fluidly connects the second injection point 330 on the lower side of the body 310 to the upper burner section 310*b* on the upper side of the body 310. For example, the passageway 332 can be a discrete passageway such as an aperture or opening, channel, cavity, conduit, etc. capable of guiding a flow of the second air-gas mixture through the body of the burner from the lower side to the upper side. In other examples, more than one passageway 332 and/or injection points 330 can be provided. The passageway 332 can include a tunnel, venturi, or the like, either integrally formed with or inserted into the passageway 332, for mixing the air-gas mixture and supplying the second air-gas mixture to the upper burner section 310*b*. In examples with a separately formed insert, such as a tunnel, venturi, or the like, the passageway 332 can be configured to receive the insert, for example, vertically (e.g., inserted from above or below) or from the side (e.g., inserted into a slot from the side). The burner 300 can be configured to receive and mix injected gas and primary air within the passageway 332, such that the burner 300 can be configured as a top-breathing burner (i.e., in which primary air is drawn from above the cooktop floor 102), or to convey an air-gas mixture supplied to the passageway 332, such that the burner 300 can be configured as either a top-breathing burner or a bottom-breathing burner (i.e., in which an air-gas mixture is supplied from below the cooktop floor). The air, gas, and/or air-gas mixture can be injected into the passageway 332 in a vertical direction or another direction, such as from the side (e.g., in a radial direction of the passageway 332). For example, as shown in FIG. 4, a portion of the wall 331 at the entrance to the passageway 332 can be recessed, slotted, etc. to enable air and/or gas to be injected or drawn from the side of the entrance to the passageway 332.

In the example shown in FIG. 4, the partition wall 331 is integrally formed by a portion of the wall 322 to seal the second injection point 330 from the first chamber 320 and the first injection point 328. In other examples, the partition wall 331 can be separately formed from the wall 322, such as a separate wall extending from the plate 311 or a part of a tunnel insert (e.g., a venturi or other component) that is inserted into the passageway 332 and seals the second injection point 330 from the first chamber 320 and the first injection point 328.

With reference to the example in FIG. 5, the passageway 332 extends through the plate 311 and fluidly connects the second injection point 330 on the lower side of the body 310 to the upper burner section 310*b* on the upper side of the body 310. The passageway 332, or a separate insert disposed within the passageway (e.g., a separate venturi, tunnel component, etc.), can guide and exhaust the air-gas mixture into a second chamber 340 in the upper burner section 310*b*, which is defined by one or more walls 342, 346 extending from and cooperating with the upper (top) side, or surface, of the plate 311. One or more supports 315 can be provided to support a cap or the like on top of the upper burner section 310*b* for closing the top of the second chamber 340.

The upper end of the passageway 332, or a separate insert disposed within the passageway (e.g., a separate venturi, tunnel component, etc.), can be tapered, angled, etc. to promote a smooth flow of the air-gas mixture into the second chamber 340. The injected air-gas mixture is guided by the walls 342, 346 throughout the second chamber 340. In this example, the upper burner section 310*b* is configured for a single injection point 330. However, in other examples, multiple injection points can be provided, such as an injection point being located in one or more fingers of the star configuration or other locations within the second chamber 340. The walls 342, 346 can include a plurality of ports 344 (i.e., second ports) configured to permit the second air-gas mixture to exit the second chamber 340, where the air-gas mixture can be ignited to form an upper flame ring. For simplicity, the ports 344 are schematically illustrated in the walls 342, 346. One of ordinary skill will recognize that the ports can have various designs and configurations, such as various shapes, sizes, angles, spacings, etc. and can be formed in all or a portion of the walls 342, 346 depending, for example, on the shape/configuration of the perimeter of the burner, desired flame pattern, etc. As mentioned, the plate 311 can include one or more ignition points 334 such that the air-gas mixture exiting one or more of the ports 324 can be ignited at one or more locations, for example, by an igniter (not shown). In this example, the air-gas mixture exiting the ports 344 can be ignited at a single location 334 such that, upon ignition, the flame ring propagates in both directions 336 away from the location 334 around a perimeter of the wall 342, 346 to form the upper flame ring(s).

The walls 342, 346 can extend, for example, around of a perimeter of the body 310 along an outer edge 312 of the lower or bottom side of the plate 311 and along an inner edge 314 of the central opening. In this example, the walls 342, 346 are formed by a single interconnected, continuous wall extending along both the outer edge 312 and the inner edge 314 to form a single chamber 340. In other examples, the walls 342, 346 can be separately formed along each edge 312, 314 to form a single chamber 340. The plurality of ports 344 can permit the second air-gas mixture to exit the second chamber 340 along both the outer edge 312 and the inner edge 314, thereby providing both an outer upper flame ring and an inner upper flame ring for the upper burner section 310*b*. The walls 342, 346 are not limited to being formed along the edges 312, 314 and can be configured to have other shapes, sizes, or arrangements, etc. The walls 342, 346 also can be configured to form a plurality of chambers, as will be described with reference to other examples below.

Figure 6:
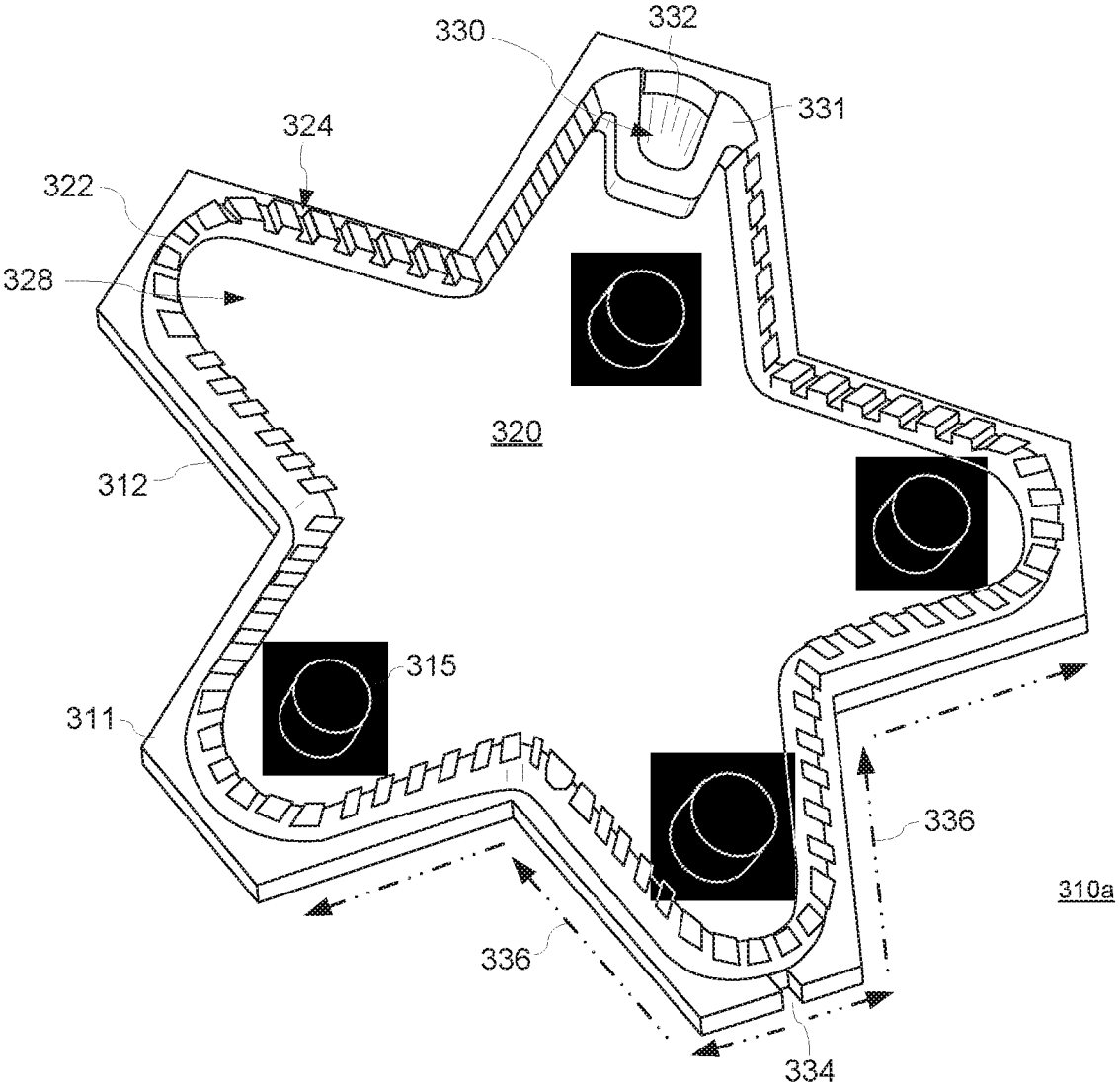
FIG. 6 is a top perspective view of a multi-level gas burner body according to an exemplary embodiment of the invention.
Figure 7:
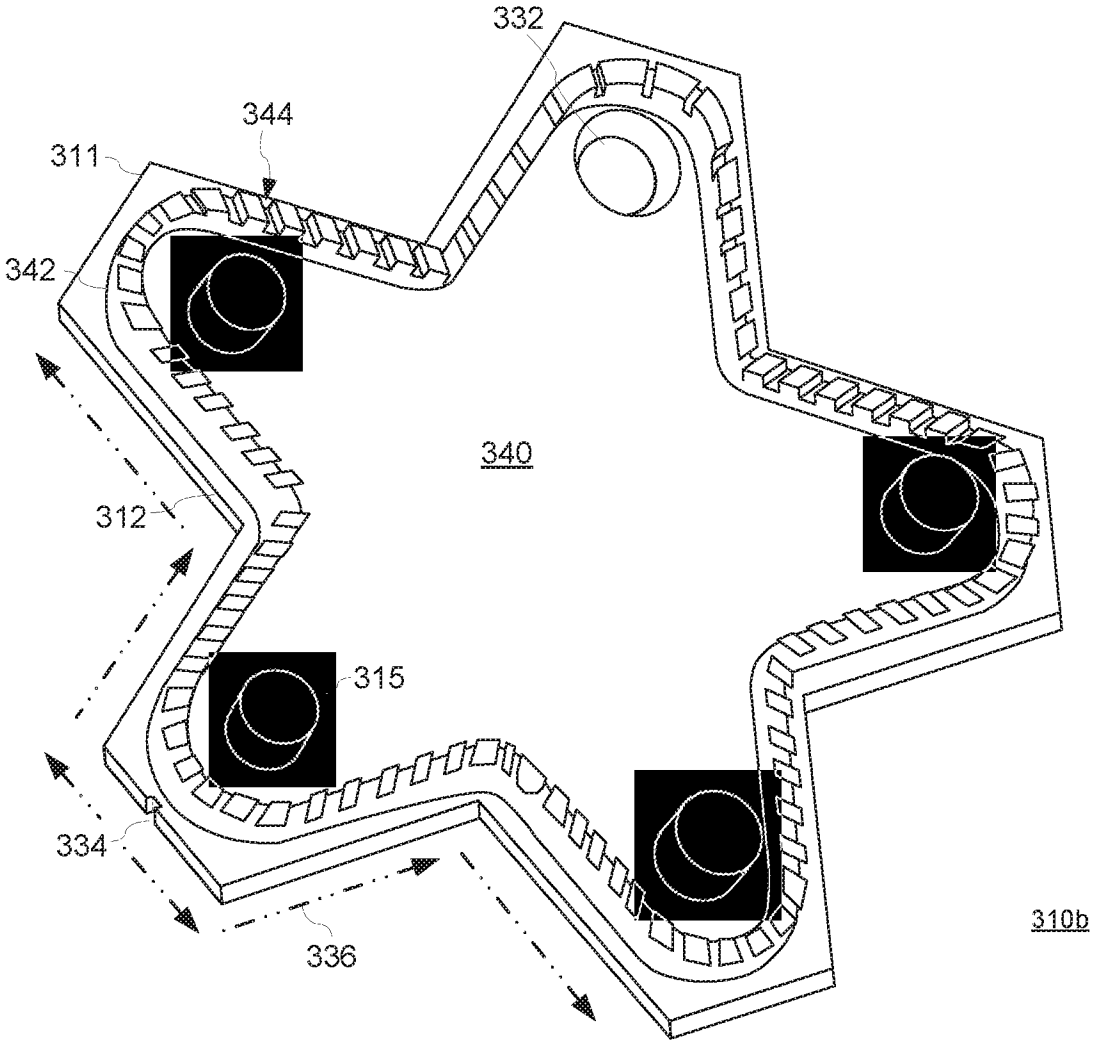
FIG. 7 is a top perspective view of the multi-level gas burner body of FIG. 6.
Figure 8:
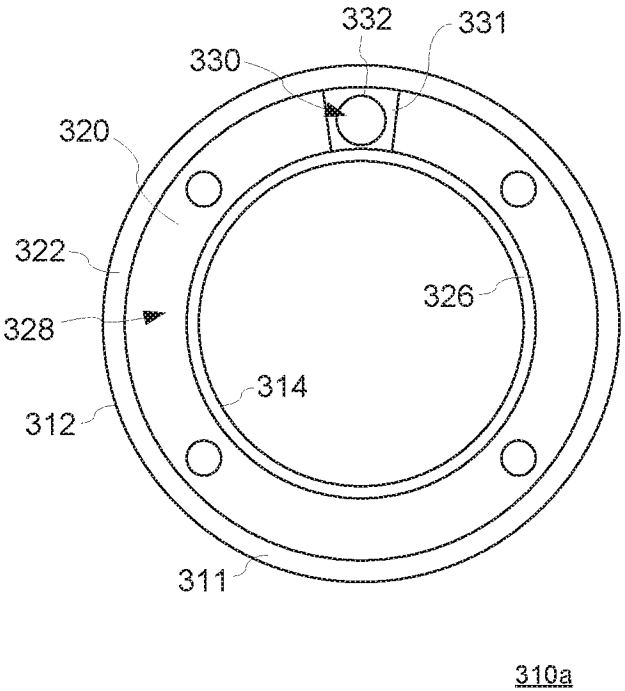
FIG. 8 is a schematic bottom view of a multi-level gas burner body according to an exemplary embodiment of the invention.

With reference to FIGS. 6 and 7, an example of a multi-level gas burner 300 can include a burner body 310 having a lower burner section 310*a* on a lower side (shown in FIG. 6) and an upper burner section 310*b* on an upper side (shown in FIG. 7) without a central opening. In this example, the lower burner section 310*a* can be defined by one or more walls 322 on the lower or bottom side of the common plate 311 that extend from and cooperate with a lower side, or surface, of the plate 311 to define a first chamber 320 configured to receive a first air-gas mixture. The wall 322 can extend, for example, around of a perimeter of the body 310 along an outer edge 312 of the lower or bottom side of the plate 311 such that the plurality of ports 324 permit the first air-gas mixture to exit the first chamber 320 along the outer edge 312, thereby providing an outer lower flame ring for the lower burner section 310*a*. In this example, the upper burner section 310*b*, shown in FIG. 7, can be defined by one or more walls 342 on the upper or top side of the common plate 311 that extend from and cooperate with an upper (top) side of the plate 311 to define a second chamber 340 configured to receive a second air-gas mixture. The wall 342 can extend, for example, around of a perimeter of the body 310 along an outer edge 312 of the upper or top side of the plate 311 such that the plurality of ports 344 permit the second air-gas mixture to exit the second chamber 340 along the outer edge 312, thereby providing an outer upper flame ring for the upper burner section 310*b*. Similar to the previously described examples, the walls 322, 342 can be formed by a single interconnected, continuous wall extending along the outer edge 312 to form a single chamber 320, 340, or the walls 322, 342 can be separately formed along the edge 312 to form a single chamber 320, 340. The walls 322, 342 are not limited to being formed along the edge 312 on each respective side, and alternatively can be configured to have other shapes, sizes, or arrangements, etc. The walls 322, 342 also can be configured to form a plurality of chambers in one or more of the upper and lower burner sections 310*a*, 310*b*. As will be understood from FIGS. 6 and 7, the burner body 310 includes a second injection point 330 that is separated or partitioned from (i.e., isolated, sealed, or fluidly disconnected from) the first chamber 320 and the first injection point 328 by a partition wall 331 or the like, thereby separating the first air-gas mixture from the second air-gas mixture. A passageway 332 extends through the plate 311 and fluidly connects the second injection point 330 on the lower side of the body 310 to the second chamber 340 of the upper burner section 310*b*.

With reference to FIGS. 8 and 9, an example of a multi-level gas burner 300 can include a burner body 310 having a circular configuration with a corresponding circular central opening. The circular gas burner can include a lower burner section 310*a* on a lower side of the common plate 311 (shown in FIG. 8) and an upper burner section 310*b* on an upper side of the common plate 311 (shown in FIG. 9), thereby providing both an outer lower flame ring and an inner lower flame ring for the lower burner section 310*a*, and both an outer upper flame ring and an inner upper flame ring for the upper burner section 310*b*. In this way, the lower and upper flame rings can be separately and independently controllable from one another.

Figure 11:
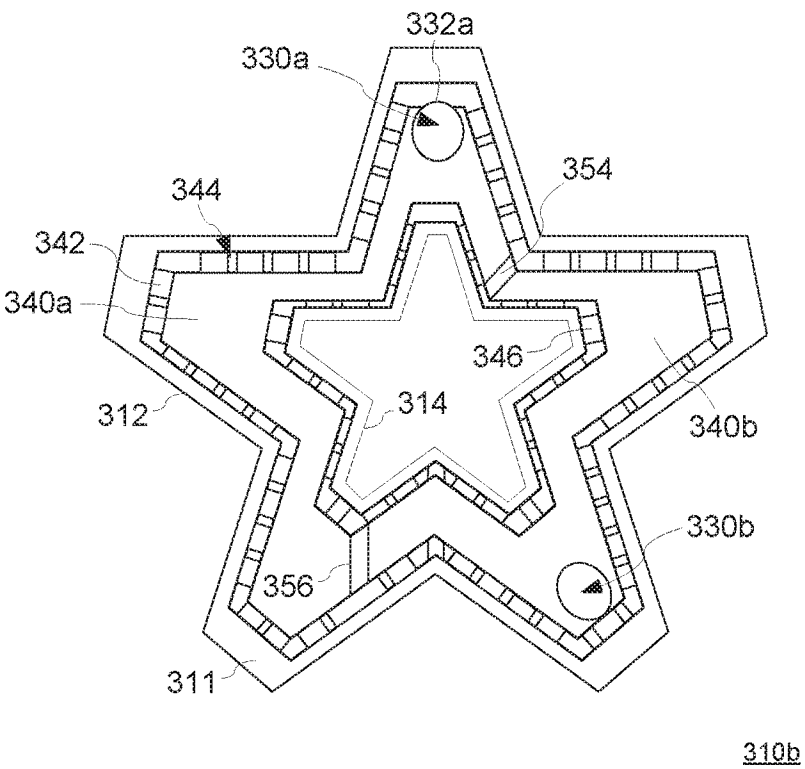
FIG. 11 is a schematic top view of the multi-level gas burner body of FIG. 10.
Figure 10:
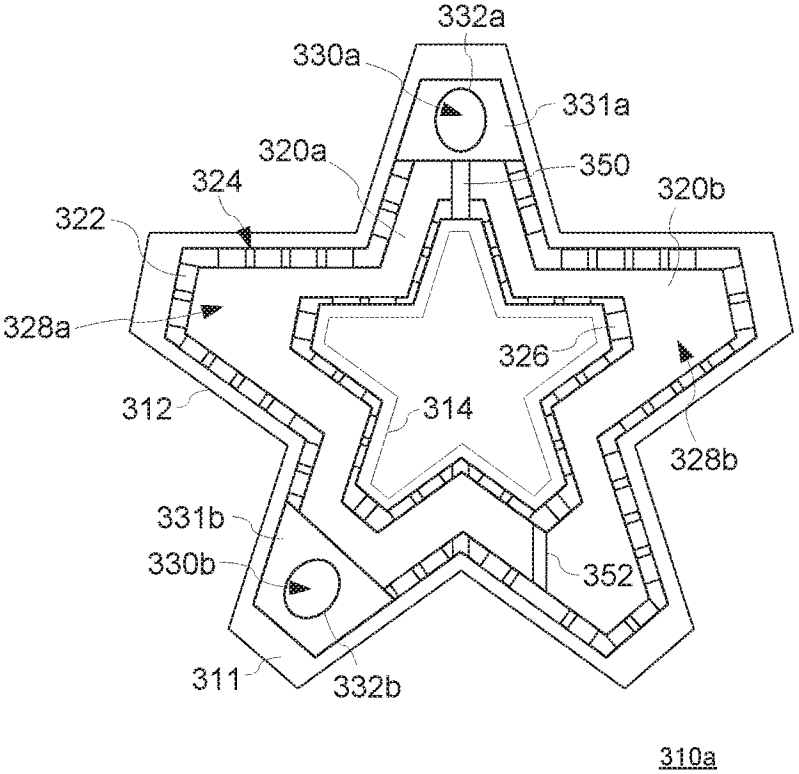
FIG. 10 is a schematic bottom view of a multi-level gas burner body according to an exemplary embodiment of the invention.

With reference to FIGS. 10 and 11, an example of a multi-level gas burner 300 can include a burner body 310 having a lower burner section 310*a* on a lower side (shown in FIG. 10) and an upper burner section 310*b* on an upper side (shown in FIG. 11), in which multiple injection points 328*a*, 328*b*, 330*a*, 330*b* can be provided, such as an injection point being located in one or more fingers of a star configuration, or other locations, to supply an air-gas mixture to a plurality of chambers 320*a*, 320*b*, 340*a*, 340*b* in each of the lower and upper burner sections 310*a*, 310*b*. In this example, the lower burner section 310*a* includes partition walls 350, 352, which partition the chamber of the lower burner section 310*a* into two chambers 320*a*, 320*b*. In other examples, one or more of the partition walls 350, 352 can be internally formed with, or formed by a part of, one or more of the partition walls 331*a*, 331*b*. The chamber 320 of the lower burner section 310*a* is not limited to being partitioned into two chambers 320*a*, 320*b*, and can be partitioned into three or more chambers, such as one chamber for each finger of a star configuration, etc. An air-gas mixture can be injected into the chamber 320*a* at an injection point 328*a* such that the injected air-gas mixture is guided by the walls 322, 326 throughout the chamber 320*a*, and an air-gas mixture also can be injected into the chamber 320*b* at an injection point 328*b* such that the injected air-gas mixture is guided by the walls 322, 326 throughout the chamber 320*b*, thereby providing a pair of outer lower flame rings and inner lower flame rings for the lower burner section 310*a* (e.g., a pair of half flame rings).

In this example, the lower burner section 310*a* also can include a plurality of injection points 330*a*, 330*b* for receiving another (second) air-gas mixture for the upper burner section 310*b* (shown in FIG. 11). The injection points 330*a*, 330*b* are separated or partitioned from (i.e., isolated, sealed, or fluidly disconnected from) the chambers 320*a*, 320*b* and the injection points 328*a*, 328*b* by partition walls 331*a*, 331*b*, respectively, thereby separating the air-gas mixture for chambers 320*a*, 320*b* from the air-gas mixture for chambers 340*a*, 340*b*. As shown in FIGS. 10 and 11, the lower burner section 310*a* can include passageways 332*a*, 332*b*, which extend through the plate 311 and fluidly connect the injection points 330*a*, 330*b*, respectively, to the upper burner section 310*b* on the upper side of the body 310.

With reference to the example in FIG. 11, the passageways 332*a*, 332*b* (or separate inserts disposed within one or more of the passageways, such as a separate venturi, tunnel component, etc.), can guide and exhaust the air-gas mixture into chambers 340*a*, 340*b* in the upper burner section 310*b*. The chambers 340*a*, 340*b* can be defined by one or more walls 342, 346 extending from and cooperating with the upper side, or surface, of the plate 311, along with partition walls 354, 356, which partition the chamber of the upper burner section 310*b* into the two chambers 340*a*, 340*b* (e.g., providing a pair of half flame rings). The number of chambers of the upper burner section 310*b* is not limited to two chambers 340*a*, 340*b*, and can be partitioned into three or more chambers, such as one chamber for each finger of a star configuration, etc. The air-gas mixture can be guided by the walls 342, 346 throughout the chambers 340*a*, 340*b*, thereby providing a pair of outer upper flame rings and inner upper flame rings for the upper burner section 310*b*.

In some examples, the air-gas mixtures injected at one or more of the injection points (e.g., 328*a*, 328*b*, 330*a*, 330*b*) can be separately controllable (e.g., by one or more individual control valves, a dual control valve, a valve assembly, etc.) such that one or more portions of the outer flame rings and inner flame rings for the lower and upper burner sections 310*a*, 310*b*, respectively, can be configured to be separately and independently controllable from one or more of the other chamber portions. In this way, not only can the lower burner section 310*a* be independently operable and controllable from the upper burner section 310*b*, but one or more chambers (e.g., 320*a*, 320*b*, 340*a*, 340*b*) within the lower burner section 310*a* and/or the upper burner section 310*b*, respectively, can be independently operable and controllable from the others, thereby providing a greater level of control of the heat output of the burner 300, as well as control of a distribution of the heat output, such as a location (e.g., laterally or radially from a center of the burner) of various portions of the flame rings and/or a distance/proximity (e.g., vertical distance) of various portions of the flame rings with respect to a cooking vessel on the cooking support surface. For example, in one instance, all of the chambers in the lower and upper burner sections 310*a*, 310*b* can be supplied with a maximum flow of an air-gas mixture at one time to provide a maximum BTU output for the burner. In other instances, one or more chambers (e.g., 320*a*, 320*b*, 340*a*, 340*b*) within the lower burner section 310*a* and/or the upper burner section 310*b* can be reduced, or turned off completely, to selectively reduce an amount of heat, alter a distribution of the heat (e.g., a location of the heat laterally or radially, a vertical proximity of the heat, etc.) with respect to the cooking vessel, thereby providing greater control of the amount, intensity, and distribution of the heat for cooking operations. In a further example, a user may turn off a flow of the air-gas mixture to all of the chambers of the upper burner section 310*b* to reduce a heat output of the burner at the outermost perimeter of the burner and at a location that is vertically closest to the cooking vessel, as well as turn off all but one of the chambers of the lower burner section 310*a*, thereby leaving only a single chamber of the lower burner section 310*a* to be supplied with an air-gas mixture such that a partial flame ring (e.g., a half, third, quarter flame ring, etc.) is provided at a lowest vertical location on the burner and a more centrally located position with respect to the burner. In this way, the examples can provide an ultra-low simmer that reduces or minimizes chances of scorching.

Figure 13:
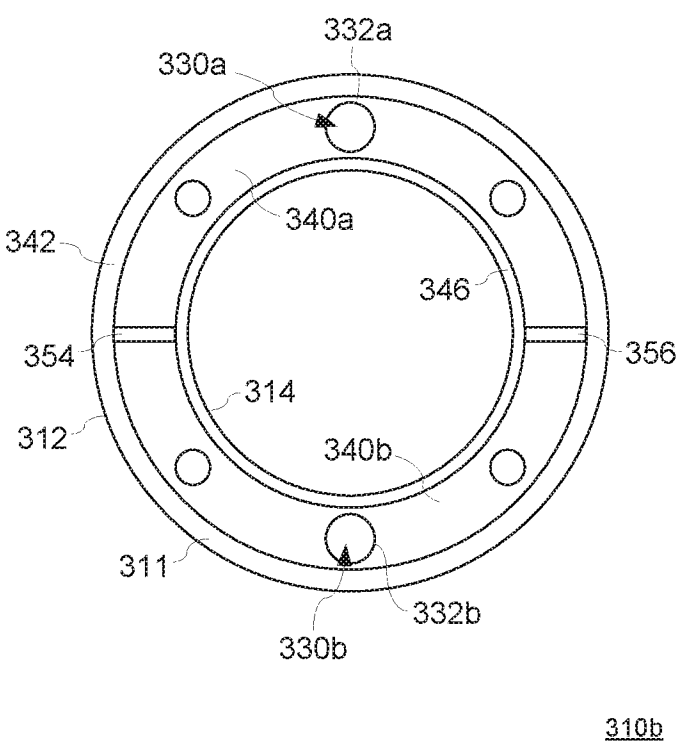
FIG. 13 is a schematic top view of the multi-level gas burner body of FIG. 12.
Figure 12:
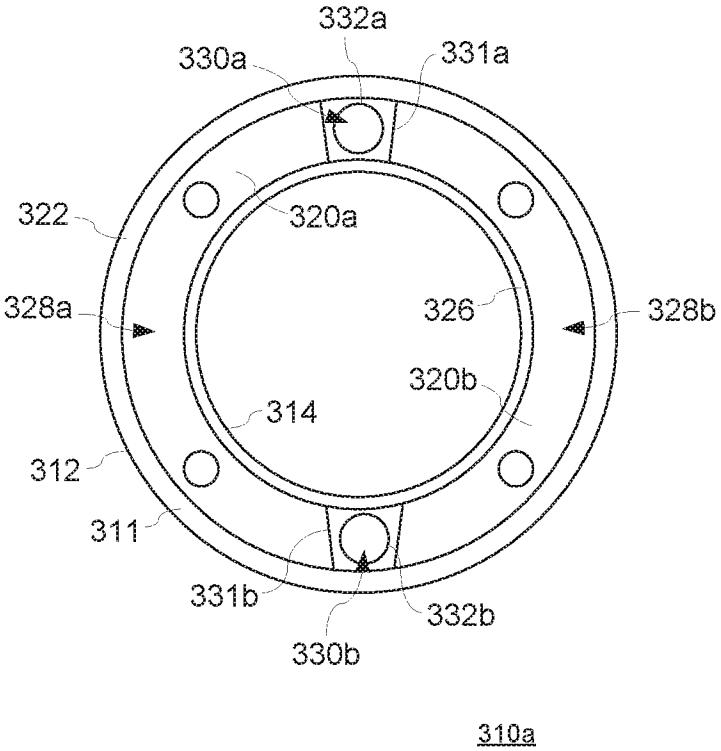
FIG. 12 is a schematic bottom view of a multi-level gas burner body according to an exemplary embodiment of the invention.

FIGS. 12 and 13 illustrate an example of a multi-level gas burner 300 in which multiple injection points 328*a*, 328*b*, 330*a*, 330*b* can be provided to supply an air-gas mixture to a plurality of chambers 320*a*, 320*b*, 340*a*, 340*b* in each of the lower and upper burner sections 310*a*, 310*b*, in which the burner body 310 has a circular configuration. In this example, similar to the example in FIGS. 10 and 11, the partition walls 331*a*, 331*b* partition the chamber of the lower burner section 310*a* into two chambers 320*a*, 320*b*. An air-gas mixture can be injected into the chamber 320*a* at an injection point 328*a* such that the injected air-gas mixture is guided by the walls 322, 326 throughout the chamber 320*a*, and an air-gas mixture also can be injected into the chamber 320*b* at an injection point 328*b* such that the injected air-gas mixture is guided by the walls 322, 326 throughout the chamber 320*b*, thereby providing a pair of outer lower flame rings and inner lower flame rings for the lower burner section 310*a*. The lower burner section 310*a* also can include a plurality of injection points 330*a*, 330*b* for receiving another (second) air-gas mixture for the upper burner section 310*b* (shown in FIG. 13). In this example, the partition walls 331*a*, 331*b* can serve a dual purpose of partitioning the chamber of the lower burner section 310*a* into two chambers 320*a*, 320*b*, as well as separating or partitioning (i.e., isolating, sealing, or fluidly disconnecting) the injection points 330*a*, 330*b* from the chambers 320*a*, 320*b* and the injection points 328*a*, 328*b*, thereby separating the air-gas mixture for chambers 320*a*, 320*b* from the air-gas mixture for chambers 340*a*, 340*b*. As shown in FIGS. 12 and 13, the lower burner section 310*a* can include passageways 332*a*, 332*b*, which extend through the plate 311 and fluidly connect the injection points 330*a*, 330*b*, respectively, to the upper burner section 310*b* on the upper side of the body 310. As shown in FIG. 13, the passageways 332*a*, 332*b* (or separate inserts disposed within one or more of the passageways, such as a separate venturi, tunnel component, etc.) can guide and exhaust the air-gas mixture into chambers 340*a*, 340*b* in the upper burner section 310*b*. The chambers 340*a*, 340*b* can be defined by the walls 342, 346 extending from and cooperating with the upper side, or surface, of the plate 311, along with partition walls 354, 356, which partition the chamber of the upper burner section 310*b* into the two chambers 340*a*, 340*b*. The air-gas mixture can be guided by the walls 342, 346 throughout the chambers 340*a*, 340*b*, thereby providing a pair of outer upper flame rings and inner upper flame rings for the upper burner section 310*b*. In some examples, the air-gas mixtures injected at one or more of the injection points (e.g., 328*a*, 328*b*, 330*a*, 330*b*) can be separately controllable (e.g., by one or more individual control valves, a dual control valve, a valve assembly, etc.) such that one or more portions of the outer flame rings and inner flame rings for the lower and upper burner sections 310*a*, 310*b*, respectively, can be configured to be separately and independently controllable from one or more of the other chamber portions. In this way, not only can the lower burner section 310*a* be independently operable and controllable from the upper burner section 310*b*, but additionally, one or more chambers (e.g., 320*a*, 320*b*, 340*a*, 340*b*) within the lower burner section 310*a* and/or the upper burner section 310*b*, respectively, can be independently operable and controllable from the others, thereby providing a greater level of control of the heat output of the burner 300, as well as control of a distribution of the heat output, such as a location (e.g., laterally or radially from a center of the burner) of various portions of the flame rings and/or a distance/proximity (e.g., vertical distance) of various portions of the flame rings with respect to a cooking vessel on the cooking support surface. The example burners can provide a large range of heating options ranging, for example, from 500 BTU to 22,000 BTU, and in some examples, greater than 22,000 BTU.

One of ordinary skill in the art will recognize that other arrangements and configurations are possible within the spirit and scope of the examples illustrated.

For example, a burner body 310 according to the invention can have a single chamber 320 or 340 on one side of the burner body 310*a* or 310*b* (e.g., the lower or upper burner section), and a plurality of chambers 320*a*, 320*b*, 340*a*, and/or 340*b* on the other side of the burner body 310*a* or 310*b*. In other examples, a burner body can include a plurality of chambers 320*a*, 320*b*, 340*a*, and/or 340*b* on either or both sides of the burner body 310*a*, 310*b* (e.g., the lower or upper burner section) with the number of chambers 320*a*, 320*b*, 340*a*, and/or 340*b* being different for each side 310*a*, 310*b*. The number of first injection points 328, 328*a*, and/or 328*b* can be the same as, or different from, the number of second injection points 330, 330*a*, and/or 330*b*. The arrangement or configuration (e.g., size, shape, spacing, etc.) of the walls 322, 326, 342, and/or 346, ports 324 and/or 344, partition walls 331, 331*a*, and/or 331*b*, and/or partition walls 350 and/or 352 can be the same as, or different for, each side 310*a*, 310*b*.

Figure 14:
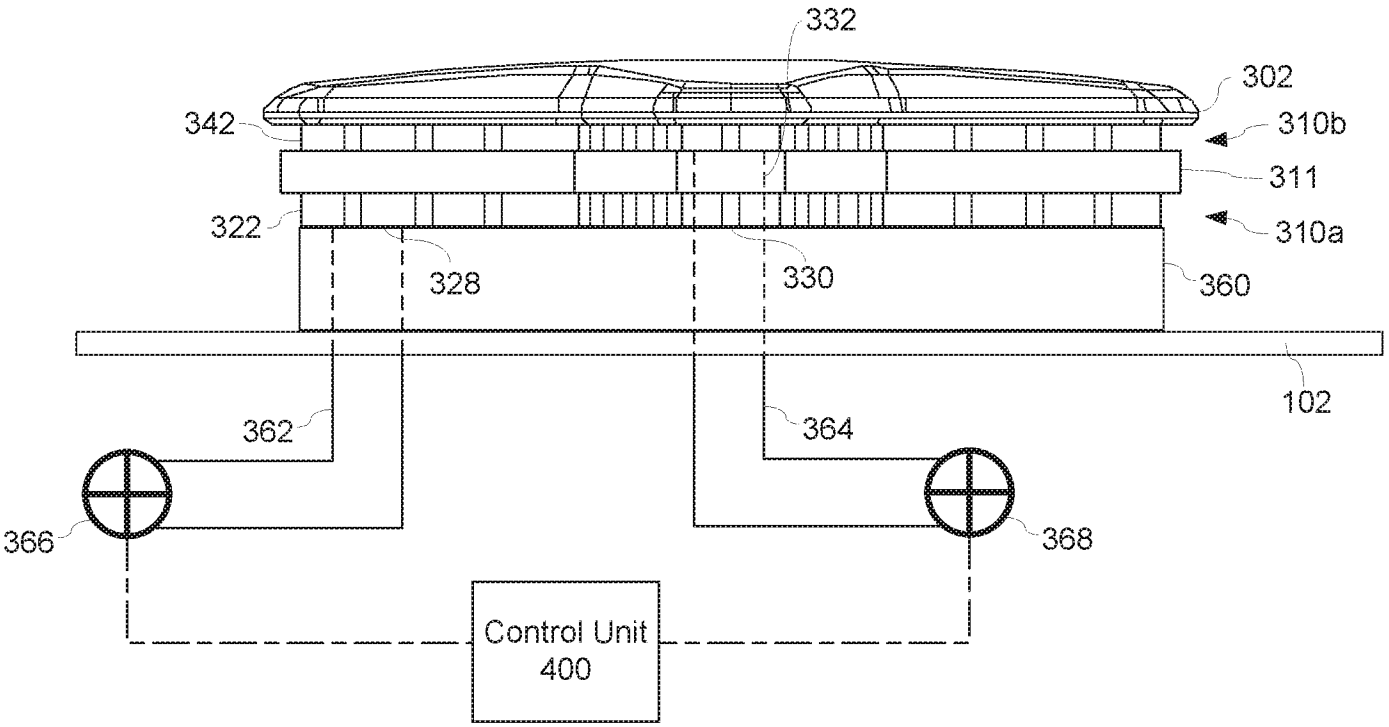
FIG. 14 is a schematic side view of a multi-level gas burner according to an exemplary embodiment of the invention.
Figure 15:
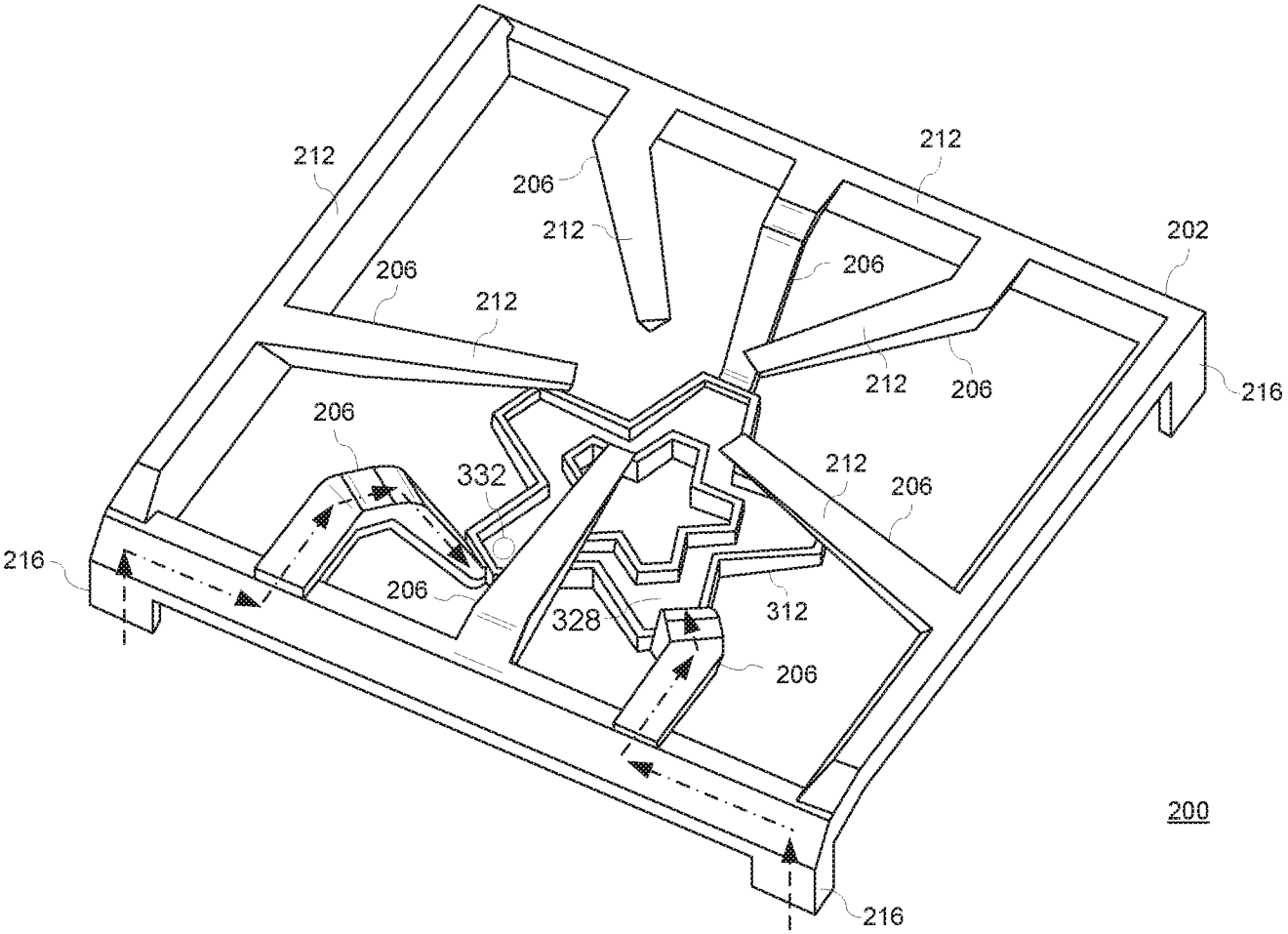
FIG. 15 is a schematic perspective view of a cooking vessel support system having an integral multi-level gas burner body according to an exemplary embodiment of the invention.
Figure 16:
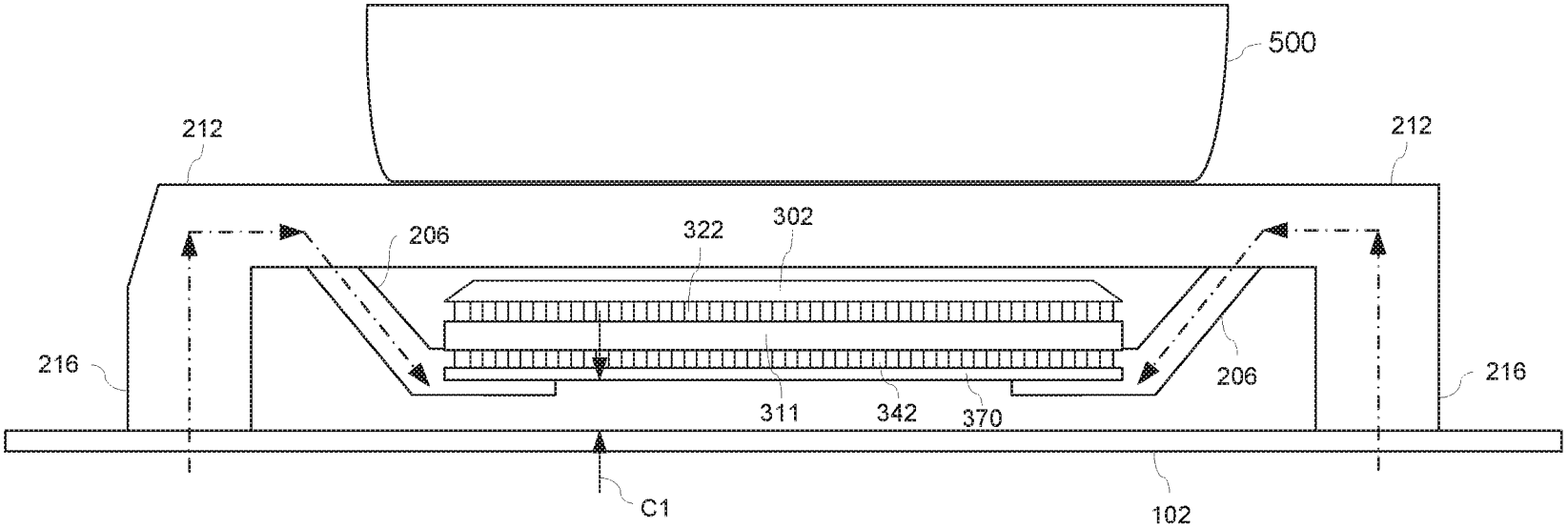
FIG. 16 is a schematic side view of a cooking vessel support system having an integral multi-level gas burner body according to an exemplary embodiment of the invention.

FIGS. 14-16 illustrate examples of a multi-level gas burner 300 implemented as part of a gas surface cooking unit (e.g., 100) of a cooking appliance (e.g., 10). For example, FIG. 14 illustrates an example of a household cooking appliance having a burner assembly including a multi-level gas burner 300 disposed on a cooktop floor 102. In this example, the burner 300 has a lower burner section 310*a* that is separated or partitioned from an upper burner section 310*b* by a plate portion 311 (e.g., a common plate portion). The lower burner section 310*a* is defined by walls 322 on the lower or bottom side of the common plate 311 and the upper burner section 310*b* is defined by walls 342 on the upper or top side of the common plate 311. The burner body 310 can be supported on the cooktop floor by a pedestal 360, or in other examples, mounted directly on the cooktop floor 102 or on an integral volcano-style pedestal, etc. A cap 302 is provided on top of the upper burner section 310*b*. In this example, a first gas supply (or air-gas mixture) can be supplied by a first gas supply line 362 and injected into a chamber of the lower burner section at a first injection point 328. The first gas can be mixed with air below the cooktop surface 102 in a bottom-breathing arrangement, or the air can be drawn from a region above the cooktop floor 102 and mixed with the first gas in a top-breathing arrangement. One or more control valves 366 can be configured to control a flow of the first gas to the lower burner section (or to one or more chambers of the lower burner section). A second gas supply can be supplied by a second gas supply line 364 and injected into the lower burner section at a second injection point 330. A passageway 332 extends through the plate 311 and fluidly connects the second injection point 330 to the upper burner section 310*b*. The second gas can be mixed with air below the cooktop surface 102 in a bottom-breathing arrangement, or the air can be drawn from a region above the cooktop floor 102 and mixed with the second gas within the passageway 332 (e.g., in a venturi) in a top-breathing arrangement. One or more control valves 368 can be configured to control a flow of the second gas to the upper burner section (or to one or more chambers of the upper burner section).

In the examples, one or more control valves (e.g., 366, 368) can be separately provided to individually control the supply of gas to one or more of the chambers of the lower and/or upper burner sections 310*a*, 310*b*. In other examples, a dual control valve, a valve assembly, etc. can be provided to control more than one flow of gas to the chambers of the lower and/or upper burner sections 310*a*, 310*b*. In some examples, a control unit 400 can be configured to control the valve system (e.g., 366, 368) to separately control a flow of the first air-gas mixture to the lower burner section 310*a* and the second air-gas mixture to the upper burner section 310*b* such that the lower burner section 310*a* is independently operable and controllable from the upper burner section 310*b*. In other examples, a control unit 400 can be configured to control the valve system (e.g., 366, 368) to separately control a flow of the first air-gas mixture to one or more chambers of the lower burner section 310*a* and/or a flow of the second air-gas mixture to one or more chambers of the upper burner section 310*b* such that, not only is the lower burner section 310*a* independently operable and controllable from the upper burner section 310*b*, but additionally, one or more chambers within the lower burner section 310*a* and/or the upper burner section 310*b* are independently operable and controllable from each other, thereby providing a greater level of control of the heat output of the burner 300, as well as control of a location of the flame and a distance of the flame from a cooking vessel on the cooking support surface. The control unit 400 can control the valves in response to a user input to a user interface device (e.g., a control knob, touch screen, computer or phone app, etc.), or the control unit 400 can be configured to control (e.g., automatically control) the flow of gas to each respective chamber of the lower and upper burner sections 310*a*, 310*b* based on an analysis/determination using an input received from one or more sensors, such as a temperature sensor, smoke or fire detection sensor, etc., from the cooking appliance and/or from another appliance, such as from a kitchen exhaust system (e.g., exhaust hood, downdraft exhaust system, etc.), HVAC system, etc.

FIGS. 15 and 16 schematically illustrate other examples of a multi-level gas burner 300 integrally formed with a cooking vessel support system 200, which is disposed on a cooktop floor 102. In these examples, the multi-level gas burner 300 can have the features of one or more of the examples illustrated in FIGS. 4-14. The cooking vessel support system 200 can include a support frame 202 that supports a multi-level gas burner 300 above and spaced apart from the cooktop floor 102, while at the same time discretely delivering an air-gas mixture to the gas burner 300 through the cooking vessel support frame 200. In these examples, one or more arms 206 of a support frame 202 can be configured to support the gas burner body 300 such that an upper surface of the burner cap 302 is positioned below the upper surface portions 212 of the support frame 202, while a lower surface of the burner body 310 is positioned above and spaced apart from the cooktop floor 102 when the support system 200 is positioned on the cooktop floor 102, thereby providing the appearance of the gas burner 300 floating between the support frame 202 and the cooktop floor 102. As shown in the example, one or more of the arms 206 can include a first end coupled to or integrally formed with the support frame 202. A portion of an arm 206 can be angled or curved downward below the upper surface portions 212 of the arms 206 such that a second end of the arm 206 can be coupled to, or integrally formed with, a part of the burner body 310 of the gas burner 300. In the example shown, a star-shaped burner body 310 is coupled to and supported by three arms 206, which are coupled to three of the fingers, or points, of the burner body 310 having the star configuration. In other embodiments, the burner body 310 can have other shapes, arrangements, etc., and the burner can be coupled to and supported by any number of arms 206, such as a single arm, two arms, three arms, four arms, five arms, etc.

As schematically shown in FIG. 16, the lower surface of the gas burner body 310 can be disposed at a higher position (i.e., in a different plane) than a lower surface of the base 216 of the support frame 202, which rests on the cooktop floor 102, thereby providing a vertical clearance C1 (e.g., a predetermined vertical clearance) between the lower surface of the gas burner body 310 and the cooktop floor 102. The vertical clearance C1 may make it easier for a user to access and clean the surface of the cooktop floor 102 under the gas burner body 310 when the support system 200 is mounted on the cooktop floor 102. The vertical clearance C1 also may provide sufficient separation or distance between the burner 300 and the cooktop floor 102 to minimize or prevent burning of spills (e.g., a liquid or solid) onto the cooktop floor 102, thereby further improving the cleanability of the appliance. The vertical clearance C1 also may improve a flow of secondary air to the burner 300 from around burner 300 (e.g., from below or from the sides of the burner 300), which may improve combustion and flame production and increase the performance of the burner 300.

The cooking vessel support system 200 can be configured to discretely convey separate air-gas mixtures through passageways formed in one or more of the arms 206 of the support frame 202 to one or more of the injection points 328, 330 of a multi-level gas burner 300, as described in the examples in FIGS. 4-14, while at the same time allowing the cooking vessel support system 200 (including the support frame 202 and the gas burner 300) to be easily removable from the cooktop floor 102. The arms 206 and the burner body 310 can be configured such that the separate air-gas mixtures are injected into the injection points 328, 330 of the multi-level gas burner 300 either vertically (e.g., from below) or from the side (e.g., though a slot or recess formed in a side of a portion of the burner body 310, such as a slot or recess in the petition 331, wall 322, and/or wall 342, etc.).

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A gas burner for a cooktop of a cooking appliance, the gas burner comprising:

a body having a lower burner section on a lower side and an upper burner section on an upper side, the lower burner section being separated from the upper burner section, the lower side of the body having a first injection point for receiving a first air-gas mixture for the lower burner section and a second injection point for receiving a second air-gas mixture for the upper burner section, the first injection point being partitioned from the second injection point thereby separating the first air-gas mixture from the second air-gas mixture, wherein the body includes a passageway fluidly connecting the second injection point on the lower side of the body to the upper burner section on the upper side of the body.

2. The gas burner of claim 1, wherein the body comprises:

a plate portion dividing the lower burner section on the lower side from the upper burner section on the upper side of the body, a first wall on the lower side of the plate portion, the first wall defining the lower burner section on the plate portion and including a plurality of first ports configured to permit the first air-gas mixture to exit the lower burner section; and a second wall on the upper side of the plate portion, the second wall defining the upper burner section and including a plurality of second ports configured to permit the second air-gas mixture to exit the upper burner section.

3. The gas burner of claim 2, wherein the first wall is disposed along a perimeter of the lower side of the plate portion.

4. The gas burner of claim 3, wherein the second wall is disposed along a perimeter of the upper side of the plate portion.

5. The gas burner of claim 2, wherein the plate portion includes a central opening, and the first wall has a first portion disposed along a perimeter of an outer edge of the lower side of the plate portion and a second portion disposed along a perimeter of the central opening in the body, the first portion and the second portion of the first wall defining the lower burner section.

6. The gas burner of claim 5, wherein the second wall has a first portion disposed along a perimeter of an outer edge of the upper side of the plate portion and a second portion disposed along the perimeter of the central opening in the body, the first portion and the second portion of the second wall defining the upper burner section.

7. The gas burner of claim 1, wherein the first injection point includes a plurality of first injection points spaced within the lower burner section, each of the plurality of first injection points being partitioned from the second injection point thereby separating the first air-gas mixture from the second air-gas mixture.

8. The gas burner of claim 7, wherein the lower burner section includes at least one partition wall dividing the lower burner section into a plurality of separate lower chambers, and each of the plurality of first injection points is disposed in a respective lower chamber of the plurality of separate lower chambers for supplying the first air-gas mixture to the respective lower chamber of the lower burner section.

9. The gas burner of claim 7, wherein the second injection point includes a plurality of second injection points spaced on the lower side of the body, each of the plurality of second injection points being partitioned from the plurality of first injection points thereby separating the first air-gas mixture from the second air-gas mixture, and wherein the body includes a plurality of passageways fluidly connecting each of the plurality of second injection points to the upper burner section.

10. The gas burner of claim 9, wherein the upper burner section includes at least one partition wall dividing the upper burner section into a plurality of separate upper chambers, and each of the plurality of passageways is in fluid communication with a respective upper chamber of the plurality of separate upper chambers for supplying the second air-gas mixture to the respective upper chamber of the upper burner section.

11. The gas burner of claim 9, wherein each of the plurality of passageways includes a venturi for supplying the second air-gas mixture to the upper burner section.

12. The gas burner of claim 1, wherein the body comprises a plurality of first ports around a perimeter of the lower burner section and a plurality of second ports around a perimeter of the upper burner section, the plurality of first ports configured to permit the first air-gas mixture to exit the lower burner section to be ignited to form a lower flame ring and the plurality of second ports configured to permit the second air-gas mixture to exit the upper burner section to be ignited to form an upper flame ring.

13. The gas burner of claim 12, wherein a perimeter of the body has one of a circular configuration, a rectangular configuration, and a star configuration.

14. The gas burner of claim 12, wherein the body includes:

a central opening extending through the lower burner section and the upper burner section, and a plurality of third ports around a perimeter of the central opening at the lower burner section and a plurality of fourth ports around the perimeter of the central opening at the upper burner section, the plurality of third ports configured to permit the first air-gas mixture to exit the lower burner section into the central opening to be ignited to form a lower inner flame ring and the plurality of fourth ports configured to permit the second air-gas mixture to exit the upper burner section into the central opening to be ignited to form an upper inner flame ring.

15. The gas burner of claim 14, wherein a perimeter of the body has one of a circular configuration, a rectangular configuration, and a star configuration, and the perimeter of the central opening has a corresponding one of a circular configuration, a rectangular configuration, and a star configuration.

16. The gas burner of claim 1, wherein the passageway includes a venturi for supplying the second air-gas mixture to the upper burner section.

17. The gas burner of claim 1, wherein a perimeter of the body has a star configuration, and the first injection point is located at a first finger of the star configuration and the second injection point is located at a second finger of the star configuration.

18. The gas burner of claim 1, further comprising:

a cap on top of the upper burner section.

19. The gas burner of claim 18, further comprising:

a second cap on an underside of the lower burner section.

20. A cooking appliance comprising:

a cooktop floor; and the gas burner of claim 1, the gas burner disposed above the cooktop floor.

21. The cooking appliance of claim 20, further comprising:

a control unit configured to separately control a flow of the first air-gas mixture to the lower burner section and the second air-gas mixture to the upper burner section such that the lower burner section is independently operable and controllable from the upper burner section.

22. The cooking appliance of claim 20, further comprising:

a first control valve configured to separately control a flow of the first air-gas mixture to the lower burner section and a second control valve configured to separately control a flow of the second air-gas mixture to the upper burner section such that the lower burner section is independently operable and controllable from the upper burner section.

23. The cooking appliance of claim 20, further comprising:

a cooking vessel support system on the cooktop floor, the cooking vessel support system being removable from the cooktop floor and including a support frame configured to support a cooking vessel above the gas burner, the support frame having at least a first arm supporting the gas burner above and spaced apart from the cooktop floor.

24. The cooking appliance of claim 23, wherein the support frame includes an internal passageway in fluid communication with the gas burner and configured to convey an air-gas mixture through the support frame to the gas burner, at least a portion of the internal passageway being formed in the first arm of the support frame such that the air-gas mixture is guided by the internal passageway through the first arm to the gas burner.

* * * * *